United States Patent [19]

Tanioka et al.

[11] 4,451,136

[45] May 29, 1984

[54] FEED CONTROL FOR COPYING APPARATUS

[75] Inventors: Hiroshi Tanioka, Tokyo; Masato Ishida, Kawasaki; Tsuneki Inuzuka, Machida, all of Japan

[73] Assignee: Canon Kabushiki Kaisha, Tokyo, Japan

[21] Appl. No.: 401,246

[22] Filed: May 29, 1984

Related U.S. Application Data

[63] Continuation of Ser. No. 213,593, Dec. 5, 1980, abandoned.

[30] Foreign Application Priority Data

Dec. 13, 1979 [JP] Japan ..... 54-161870

[51] Int. Cl.[3] ..... G03G 15/00

[52] U.S. Cl. ..... 355/14 SH; 355/3 SH; 355/14 R; 355/7

[58] Field of Search ..... 355/14 SH, 3 SH, 14 R, 355/7, 50, 51, 75, 76, 8; 271/225, 226, 227

[56] References Cited

U.S. PATENT DOCUMENTS

| | | | |
|---|---|---|---|
| 2,953,372 | 9/1960 | Williams et al. | 271/226 X |
| 3,536,320 | 10/1970 | Derby | 271/226 |
| 3,754,826 | 8/1973 | Kobayashi et al. | 271/226 X |
| 3,817,515 | 6/1974 | Kanda | 271/227 X |
| 3,893,662 | 7/1975 | Boyd | 271/226 X |
| 4,015,523 | 4/1977 | Evans et al. | 271/227 X |
| 4,126,389 | 11/1978 | Ikeda et al. | 355/8 X |
| 4,211,482 | 7/1980 | Arai et al. | 355/8 |
| 4,236,808 | 12/1980 | Tusso et al. | 355/8 |
| 4,260,241 | 4/1981 | Honma et al. | 355/14 R |
| 4,310,236 | 1/1982 | Connin | 355/14 SH |

OTHER PUBLICATIONS

Japanese Laid Open Gazette No. 54625/1979.

*Primary Examiner*—A. C. Prescott

*Attorney, Agent, or Firm*—Fitzpatrick, Cella, Harper & Scinto

[57] ABSTRACT

The copying machine includes an image forming unit for forming a reproduced image of an original document on a copying sheet, a data input unit for entering data necessary for image formation, and a timing control for performing timing control of the image forming unit for image formation in response to the entered data. The image forming unit includes a rotary member for forming a transfer image on the copying sheet, and a feeder unit for repeatedly supplying the copy sheets to a transfer station. The input unit has an instruction device for selecting the position of the reproduced image on the copying sheet. The timing control device is provided with a feed control having a switch to be actuated by the image forming unit and a timer associated with the switch, and with a timer control unit for controlling operation of the timer for shifting feed timing of the feed control in response to the instruction data supplied from the instruction device.

14 Claims, 15 Drawing Figures

FEED CONTROL FOR COPYING APPARATUS

This is a continuation of application Ser. No. 213,593, filed Dec. 5, 1980 now abandoned.

BACKGROUND OF THE INVENTION

1. Field of the Invention

The present invention relates to a copying apparatus for forming reproduced images of an original document on automatically fed sheets.

In the following description a transfer-type electrophotographic copier is taken as the example of such apparatus.

2. Description of the Prior Art

In such apparatus, the starting timing for sheet feeding has conventionally been fixed in the sequence control regardless of the position of an original document on the original carriage. For this reason the original document has to be placed in an exact position, as otherwise the reproduced image becomes displaced on the transfer sheet. It has therefore often been necessary to replace the original document by opening the carriage cover for forming the image in the center of the transfer sheet.

Also in case the original image is displacedly printed toward the leading or trailing end of the original document, it has been customary to displace such original document in advance from the predetermined position in order to form the reproduced image within the transfer sheet, but such displacement for slight positional change is rather cumbersome.

Also in the case of binding plural transfer sheets, a part of the reproduced image may be hidden in the bound portion of the sheets.

SUMMARY OF THE INVENTION

An object of the present invention is to provide a copying apparatus not associated with the above-mentioned drawbacks.

Another object of the present invention is to provide a copying apparatus capable of displacing the position of a reproduced image on a copy sheet without displacing an original document on the original carriage.

Still another object of the present invention is to provide a copying apparatus capable of forming a reproduced image in the center of a copy sheet even when an original image is not placed in the exact position on the original carriage.

Still another object of the present invention is to provide a copying apparatus capable of preventing the partial hiding of reproduced image when plural copy sheets are bound.

Still another object of the present invention is to provide a copying apparatus capable of forming a reproduced image on a desired position of a copy sheet without displacing an original document and indicating such image forming position.

Still another object of the present invention is to provide a copying apparatus capable of easily displacing the reproduced image from a first position to a second position other than the standard image position.

Still another object of the present invention is to provide a copying apparatus capable of forbidding the change in the copy position during repeated copying operation thereby preventing erroneous displacement of a reproduced image.

BRIEF DESCRIPTION OF THE DRAWINGS

The foregoing and other objects of the present invention will be made apparent from the following description, taken in conjunction with the accompanying drawings, in which.

DESCRIPTION OF THE PREFERRED EMBODIMENTS

Now the present invention will be clarified in more detail by the following description of the preferred embodiments thereof to be taken in conjunction with the attached drawings.

Figure 1:
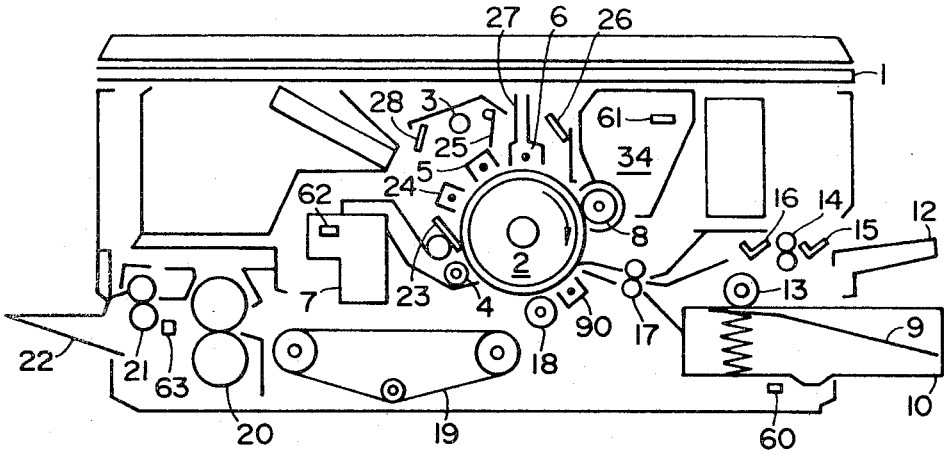
FIG. 1 is a cross-sectional view of a copying apparatus embodying the present invention.

FIG. 1 shows a copying apparatus embodying the present invention in a cross-sectional view, wherein there are shown a reciprocating carriage 1 for supporting an original document, a rotary drum 2 having a seamless photosensitive member on the periphery thereof, a lamp 3 for projecting an image of the original placed on carriage 1 onto drum 2, a corona charger 5 for positively charging the photosensitive member in advance, a negative corona charger 6 for conducting charge elimination of the photosensitive member simultaneous with the exposure thereof to the image of the original, a developing station 8 for developing an electrostatic latent image, a charger 9 for transferring thus obtained developed image onto a transfer sheet 10, a cassette 11 containing a plurality of transfer sheets and rendered detachable from the main body of the copying apparatus, a guide 12 for manually feeding the transfer sheet 10, a roller 13 for feeding the transfer sheet from the cassette, a roller 14 for feeding the transfer sheet from the manual feed guide 12, microswitches 15, 16 for detecting the manually fed transfer sheet, a register roller 17 for registering the leading end of the transfer sheet with that of the image on said drum, a separating roller 18 for separating the transfer sheet from the drum, a belt 19 for conveying the transfer sheet, a fixing roller 20, a roller 21 for ejecting the transfer sheet onto a tray 22, a blade cleaner 23 for removing the toner particles remaining on said drum, a magnet roller 4 for collecting the toner particles removed by said blade 23, a container 7 for collecting the toner recovered by the roller 4, a negative corona charger 24 for removing the charge remaining on the drum, a shutter 25 for directly exposing the drum to the light of the exposure lamp 3 for a determined period, mirrors 26, 28 for guiding the light from the exposure lamp 3 directly to the drum, and a celfoc lens 27 for focusing the light reflected by the original onto the surface of the drum.

The function of the above-explained copying apparatus is as follows. Upon turning on of a main power switch a motor is energized to initiate the rotation of the drum 2, while the lamp 3 and the corona charger 6 are turned on and the shutter 25 is opened, whereby the drum surface is cleared of the remaining toner, retentive charge and memory of the preceding image. A copy enable signal is generated when the fixing roller 20 reaches a temperature capable of fixing by means of an internal heater. If the copy switch is not actuated, the drum continues rotation until the counting of a predetermined number of pulses from a rotary encoder provided in the drum drive system and capable of generating n pulses per each turn of the drum. The above-explained drum rotation is called first pre-rotation.

In case the copy switch is closed during or after the drum rotation, the shutter 25 is closed and the drum 2 is again rotated for approximately one turn (hereinafter called the second pre-rotation), and the carriage 1 thereafter initiates the advancement to perform slit exposure of the original document placed on the carriage 1. The drum is slit-exposed to the reflected light through the celfoc lens. The photosensitive member of the drum 2 is composed of an insulating layer, a photoconductive layer and a conductive layer from the periphery thereof. The drum surface charged by the charger 5 is subjected, at the exposure station, to the elimination of positive charge by the negative charger 6 and the light image, and is then uniformly exposed to the light coming from the mirror 26 to form an electrostatic latent image of an elevated contrast on said drum surface. The latent image is rendered visible by toner deposition in the developing station. The visible image thus obtained is transferred onto the transfer sheet by means of a positive potential applied by the transfer charger in the transfer station. The transfer sheet is supplied sheet by sheet from the cassette 10 by the function of the paper feed roller 13, and is advanced in the transfer station by the register roller 17 at a speed identical with the peripheral speed of the drum. After the image transfer, the transfer sheet is separated by the roller 18, then advanced by the belt 19 to the fixing roller 20 for image fixation and finally ejected onto the tray 22 by the roller 21. The drum surface after the image transfer is cleaned by the blade 23, and further subjected to the charge elimination by the charger 24 and the memory erasure by the light coming from the lamp 3 through the mirror 28.

In case of a successive copying from the same original document, the reciprocating motion of the carriage 1 is repeated by a number previously selected by the numeral keys in the control panel of the copying apparatus.

Figure 2:
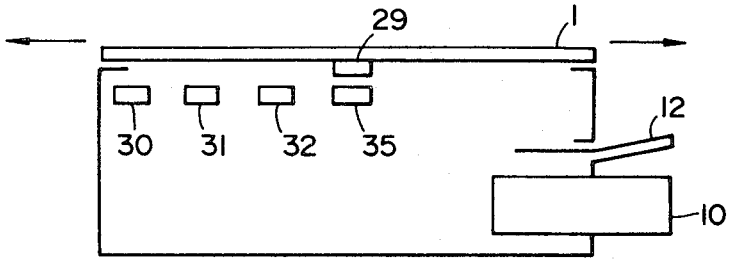
FIG. 2 is a cross-sectional view of the original carriage of the apparatus shown in FIG. 1.

FIG. 2 shows the arrangement around the carriage, wherein the carriage 29 is provided with a magnet 29, while along the advancing path of the carriage there are provided reed switches 30, 31, 32 and 35 to be actuated by the passage of magnet 29. The switch 35, when closed by the magnet 29, functions to stop the carriage in a home position at the center of the apparatus, while the switch 30, when closed, functions to initiate rightward displacement of the carriage for exposure. The switch 32 controls the paper feeding by the registering roller 17. In the case of successive copying, upon closing of the switch 30 in the backward displacement of the carriage after the first slit exposure, the carriage again initiates the forward displacement for the second cycle, and copying cycle is repeated.

The lamp 3 and the charger 6 are turned on and off in synchronization with the rotation of motor or drum, while the primary charger 5 and the pre-charger 24 are turned on except during the post-rotation cycle. The lamp 3 is so controlled as to have a higher intensity during the scanning displacement of the original carriage.

In the case of a copying operation with a manually fed sheet, the detector 15 detects the sheet upon insertion thereof from the guide 12, thereby activating the feed roller 14 to introduce the sheet into the apparatus. However the activation of said roller 14 is delayed by a certain period (approximately 2 seconds) from the sheet detection by the detector 15, in order to provide a marginal time for correcting the slantedly inserted sheet or changing the inserted sheet. After that period the roller 14 and the drum 2 are activated, and the process sequence is initiated in the same manner as the copy switch is closed. It is to be noted that the start of a copying cycle can be expedited by starting the second pre-rotation of the drum 2 simultaneously with the sheet detection by the detector 15. Upon the sheet detection the sheet feeding from the cassette is prohibited. In this manner the sheet insertion alone can initiate the copying cycle without manipulation of the copy switch, and ensures exact sheet feeding into the apparatus, thus enabling the toner image transfer onto the correct position of the sheet and preventing the sheet jamming.

The switch 16, upon detection of the passage of the trailing end of the sheet, turns off the roller 14 to prepare for the next sheet insertion.

It is to be noted that plural units of the detector 15 are provided along a direction orthogonal to the sheet advancing direction in order to detect a slanted position of the sheet, and the roller 14 is not turned on until the sheet is detected by all the detectors 15.

Figure 3:
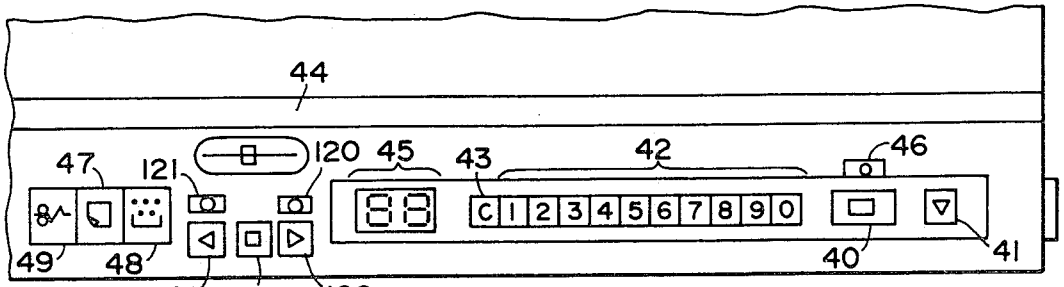
FIG. 3 is a partial plan view of the apparatus shown in FIG. 1.

FIG. 3 shows the control panel of the copying apparatus of FIG. 1, in a plan view, wherein the panel includes a main power switch 39, a copy start key switch 40, a stop key switch 41 for interrupting successive copying operation, numeral keys 42 for entering the copy number into a memory, a clear key 43 for clearing the number stored in said memory, a key 101 for advancing the paper feed timing, a key 102 for delaying the paper feed timing, lamps 121, 120 for displaying the state of paper feed timing, a key 100 for returning the paper feed timing to the normal state, a copy density select lever 44, a 7-segment display unit 45 for indicating the number stored in the memory, a waiting lamp 46 to be lighted until the fixing roller reaches the temperature for fixing, a lamp 47 for indicating the absence of the cassette or of the transfer sheets in said cassette, a lamp 48 for indicating that the container 7 is filled with the recovered toner, and a lamp 49 indicating a sheet jamming. The clear key and numeral keys are deactivated during the sheet jamming, but can be actuated during the waiting period.

The display unit 45 displays "1" (zero-suppressed) after turning on of the power switch 39 even during the waiting period. During successive copying it displays a number step decreased from the set copy number upon completion of each copying cycle, then displays the set copy number again upon completion of the copying operation, and displays "1" in case the copying operation is not restarted within 30 seconds thereafter. In this manner it is rendered possible to obtain single copy without number setting operation with numeral keys, and to rapidly repeat the successive copying operation.

The waiting lamp 46 is controlled by the actuation of the power switch 39, and becomes continuously lighted in case the fixing roller is still above the fixing temperature, i.e. in case the power switch 39 is turned on soon after it was previously turned off, while said lamp becomes intermittently lighted in the waiting condition in which the fixing roller is below the fixing temperature. The lamp is shifted to the continuously lighted state after the lapse of the waiting period after the fixing roller has reached the fixing temperature. The lamp is extinguished, when the power switch is turned off, to indicate the power-off state. Furthermore, when the copy switch is actuated after the lapse of the waiting period, said lamp is intermittently lighted with a longer interval than that in the waiting period until the drum reaches the post-rotation step. In this manner a single display lamp indicates four states, i.e. the power-on state, waiting state, stand-by state for copying and copy-in-operation state, thus reducing the number of display devices required.

The overflow indicator lamp 48 becomes lighted upon detection of the overflowing state of the container 7 and of deficient toner quantity in the container 33, for example by intermittent and continuous lighting, respectively. Also the indicator lamp 47 can indicate the absence of the transfer sheets and of the cassette, for example by intermittent and continuous lighting, respectively.

In case the toner deficiency in the hopper 33 or the toner overflow in the container 7 is detected during a successive copying operation of a copy number selected by the numeral keys, the copying operation is disabled only after the completion of said copying operation. Such detection is displayed as a warning but does not immediately stop the current copying operation, thereby preventing substantial decrease in the effective copying speed caused by such interruption, since the toner deficiency or the overflow of recovered toner does not cause immediate image deterioration or smear in the apparatus. On the other hand, in the case of the paper jamming, the function of the apparatus is immediately interrupted to ensure the safety of the apparatus. Also in response to the actuation of the stop key or upon actuation of the signal indicating the absence of sheet or cassette, the apparatus is not stopped immediately but disables the start of the succeeding process cycle after the completion of current process cycle.

The input data by the aforementioned keys are not reset but retained in case of various warning indications or in case the copying operation is interrupted or disabled for various reasons, and the resetting to the standard data takes place only when the copying operation is not initiated within 30 seconds after the data entry by said keys.

Now the function sequence and timing, principally of scanning operation, will be explained by the timing chart shown in FIG. 4.

Prior to the actuation of the copy switch 40, the carriage 1 is positioned at the center of the apparatus as shown in FIG. 1. In response to said actuation there are activated the pre-charger 24, lamp 3, primary charger 5, secondary charger 6, transfer charger 9 and shutter 25 to apply the pre-discharge, primary corona discharge, secondary corona discharge, transfer corona discharge, charge eliminating exposure, blank exposure and whole-surface exposure to the photosensitive member, thereby preparing the same for copying operations. In this state the lamp 3 is in a lower intensity state.

After the drum rotation of a determined amount controlled by the aforementioned pulse counting, the carriage initiates leftward displacement from the state shown in FIG. 1. The switch 30 is closed after approximately one turn of the drum whereby the carriage is stopped and then initiates rightward displacement for the exposure step, in which the lamp 3 is shifted to the higher intensity state, and the shutter is closed to terminate the blank exposure. Said blank exposure means a light irradiation on the imaging area conducted in the absence of image exposure in order to prevent uneven potential on the photosensitive member.

After image exposure for approximately one and a half turns of drum, the carriage is stopped and reversed toward the left in response to the counting of a determined amount of the aforementioned pulses. At the same time the copy number stored in the memory is set in a copy counting register and is step decreased. Thus, in the case of single copying, the content of said register becomes zero to disable the succeeding copying cycle. During said rightward displacement the carriage closes the reed switch 31 shown in FIG. 2 to activate the feed rollers 13, 14 and then closes the reed switch 32 to activate the registering roller 17, thereby initiating the sheet feeding. However, rollers 13, 14 and 17 are not activated even if the reed switches 31, 32 are closed during the carriage displacement other than for image exposure.

The carriage displacement is terminated when the switch 35 at the initial position is closed, whereby the lamp 3 is switched to the lower intensity and the shutter is opened to initiate the blank exposure by said lamp 3 in the weaker intensity state. The drum rotation is thereafter continued for mechanical and electrical cleaning and is then terminated after approximately one turn, when other process loads shown in FIG. 4 are also turned off, though power supply is still continued.

In case of successive copying, the carriage 1 continues leftward displacement even after the switch 35 is closed and again initiates the rightward displacement in response to the closure of the switch 30, thereby shifting the lamp 3 to the higher intensity state and closing the shutter, thus to restart the image exposure.

The timing for reversing the rightward displacement of the carriage for exposure is determined by the sheet size in the cassette 10 or manually inserted from the guide 12.

Figure 5:
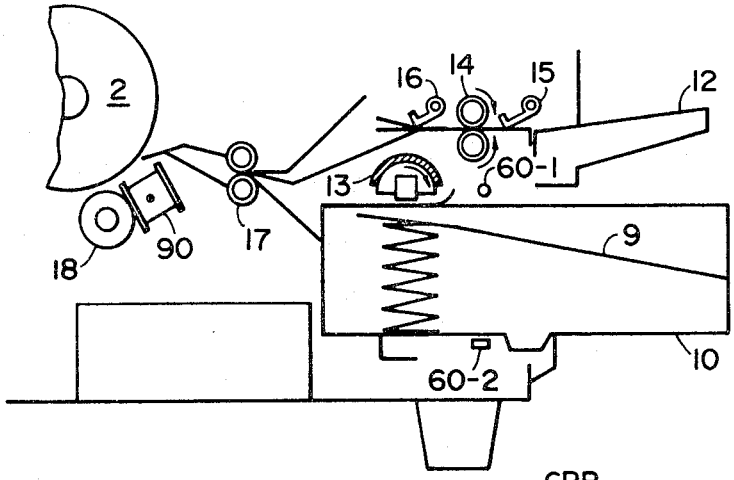
FIG. 5 is a cross-sectional view of the paper feed station of the apparatus shown in FIG. 1.

FIG. 5 shows the arrangement around the cassette and the manual sheet inserting mechanism in a vertical cross-sectional view, wherein there is a photo-interrupter 15-1 constituting the detector 15 for manually fed sheet, an actuator member 15-2 for performing a swinging motion in response to the sheet insertion, microswitches 50, 51 to be actuated by the cams provided on the cassettes when they are fitted in the apparatus and adapted to generate signals indicating the absence of a cassette when said microswitches 50, 51 are both off, or the presence of a cassette for half-sized (A4 or B5 size) sheets when said microswitches are respectively on and off, a cassette for B4-sized sheets when they are respectively off and on, and a cassette for full-sized (A3 or B3 size) sheets in case they are both on. These size indicating signals are utilized for determining the exposure stroke of the carriage 1.

With respect to the manually inserted sheet, the detector 15 identifies the half size or full size as the B4-size is included in the full size.

Consequently the required copying time can be minimized in case of a successive copying operation by continuous sheet feeding from a cassette, as the copying cycle is repeated with the minimum stroke or time corresponding to each size. On the other hand, the stroke control in the manual insertion is simplified to two different strokes as continuous sheet feeding is not often anticipated in such manual sheet insertion, whereby the control circuit is simplified to reduce the erroneous functions in the sheet size detection.

A sheet detector 16 is provided at a lefthand position with respect to the photosensitive member in a similar manner as the detector 15, and has triple functions of firstly detecting whether the manually inserted sheet is of a half size or a full size respectively when said detector 16 detects or not the sheet at a determined timing, secondly equalizing the path length from the leading end of manually inserted sheet to the registering roller with that of the sheet supplied from the cassette, by stopping the roller 14 for a determined period after the sheet detection by said detector 16 and thereafter starting said roller 14 again in response to the signal from said reed switch 31 to advance the sheet toward the registering roller, and thirdly stopping the roller 14 upon detection of the trailing end of the sheet to prepare for the next sheet insertion.

The preliminary sheet feeding performed by the rotation of roller 14 in response to the sheet detection by the detector 15 and the stopping of said roller 14 in response to the sheet detection by the detector 16 is conducted to ensure the function of the registering roller by maintaining the size of the paper loop formed by the stopped registering roller in a suitable extent, thus avoiding the paper jamming or creasing.

The sheet feeding from the cassette is achieved in a similar manner wherein the feed roller 13 is activated during a short period in response to the actuation of the copy switch to pull out a sheet from the cassette and the sheet thus pulled out is advanced to the registering roller in response to the closing of the reed switch 31.

Figure 6:
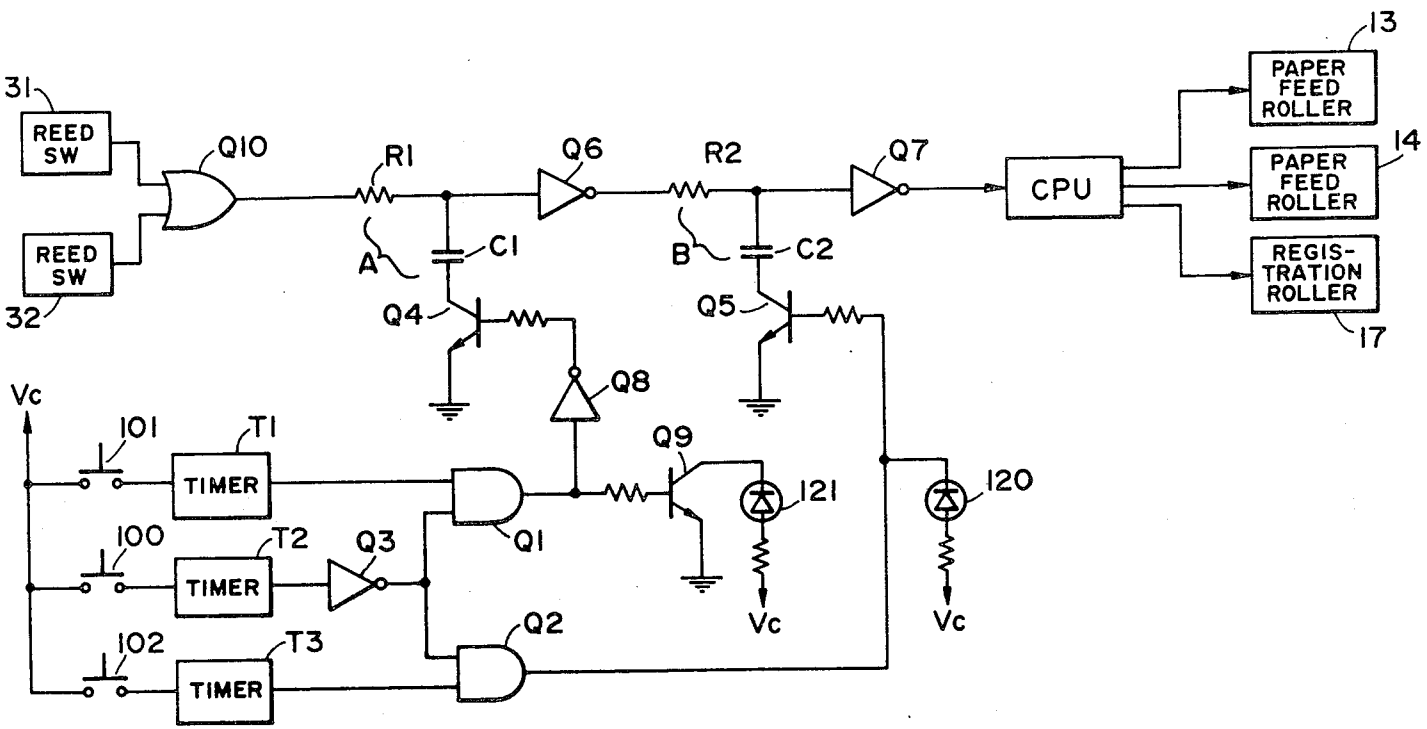
FIG. 6 is a schematic circuit diagram of an example of the timing control circuit adapted for use in the apparatus shown in FIG. 1.

FIG. 6 shows an example of the circuit for controlling the delay between the paper feed signal and the registering signal, provided with keys 101, 100 and 102 for initiating the paper feeding respectively ahead of, at and behind the normal timing; integrated circuit timers T1–T3 respectively for maintaining the state of closure of said key switches 100–102 for a determined period (approximately 30 seconds) after the actuation thereof; resistors R1, R2 and capacitors C1, C2 constituting delay circuits A and B; transistors Q4, Q5 for controlling said delay circuits; AND gates Q1, Q2 and an inverter Q8 for on-off controlling said transistors Q4, Q5; lamps 121, 120 for indicating the state of advancement or delay of paper feed timing; inverters Q6, Q7 for wave forming; and an OR gate Q10 for selecting the paper feed signal and the registering signal.

The function of the above-explained circuit is as follows. The normal paper feed timing is obtained when the key 100 is actuated or when the keys 101 and 102 are turned off, whereby the delay circuit A is activated while the delay circuit B is inactive. When the key 101 is not actuated, the gate Q1 is closed to produce a level-0 signal which, after inversion by the inverter Q8, turns on the transistor Q4 to activate the delay circuit A composed of R1 and C1. On the other hand, when the key 102 is not actuated, the gate Q2 is closed to turn off the transistor Q5 whereby the delay circuit B composed of C2 and R2 remains inactive. In this manner the paper feed signal and registering signals supplied from the reed switches 31, 32 provided in the reciprocating path of the carriage enter a central processing unit CPU after a delay determined by said delay circuit A to initiate the paper feeding at the normal timing.

In case the advancing key 101 is actuated, the timer T1 is activated to open the gate Q1 for approximately 30 seconds, whereby the transistor Q9 is turned on to light the lamp 121 indicating the shortened paper feed timing and to turn off the transistor Q4 through the inverter Q8, thus deactivating the delay circuit A composed of R1 and C1. In this state, because of the absence of an output from the gate Q2, the transistor Q5 remains in the off state to maintain the delay circuit B inactive. In case the copy switch is actuated within said 30-second period, the paper feed signal and the registering signal respectively supplied from the reed switches 31, 32 are entered to CPU earlier than the normal timing by a period determined by C1 and R1, thus respectively driving the paper feed roller 14 and the registering roller 17 at advanced timings.

After the aforementioned 30-second period the gate Q1 is closed to return the circuit automatically to the normal timing. However, even within 30 seconds from the actuation of the switch 101, the normal timing can be restored by actuating the switch 100 whereby the gate Q1 is closed to also extinguish the lamp 121.

Also, in case the key 102 is actuated, the gate Q2 is opened for approximately 30 seconds in a similar manner as explained in the foregoing to light the lamp 120 indicating the delayed feed timing and to turn on the transistor Q5 thereby activating the delay circuit B composed of C2 and B2. As the transistor Q4 remains in the on state, the entry of the feed and registering signals into CPU is delayed from the normal state by a period determined by C2 and R2, thus delaying the function of rollers 13, 14 and 17.

The delay periods can be made arbitrarily adjustable by employing variable resistors or variable condensers for R1, R2, C1 and C2, and the retaining time can be varied from 30 seconds by suitable selection of the timers T1–T3. Also, in cases where the timing for paper feeding or registering is controlled by counting serial pulses generated in response to the drum rotation instead of the aforementioned switches 31, 32, such advancement or delay of timing can be determined or adjusted by decreasing or increasing the number of pulses to be counted. Furthermore, if only a small change in timing is required, the above-explained control can be applied only to the timing related to the registering switch 32.

Figure 7:
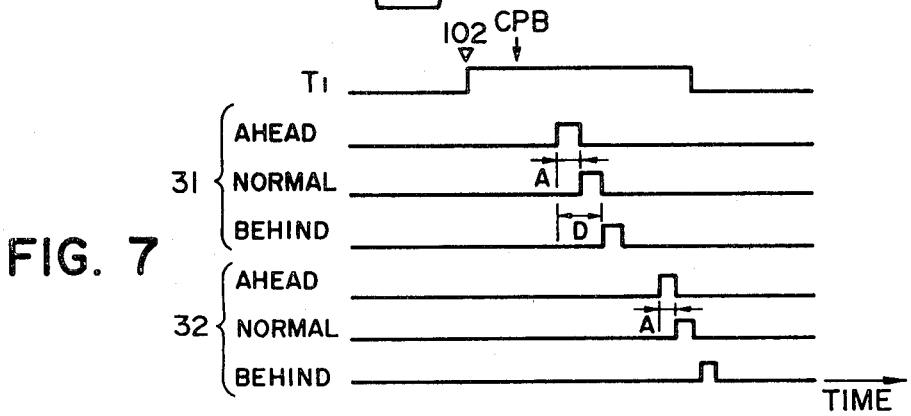
FIG. 7 is a timing chart of the circuit shown in FIG. 6.

FIG. 7 is a timing chart showing the above-explained function, in which CPB indicates the time of the copy switch actuation.

The timers T1–T3 are composed of flip-flops to be reset 30 seconds after the carriage returns to the initial position at the end of repetitive copying cycles of a predetermined copy number, so that the same timing state is maintained during a series of repetitive copying cycles of a predetermined copy number, and also in another series of copying cycles if the copy switch is actuated again soon after the completion of the preceding series, without repeated manipulation of the numeral keys. Also, the flip-flops may be reset in synchronization with the turning off of the main motor. After 30 seconds or after the main motor is turned off, the timing returns to the normal mode and the preset copy number also returns to "1".

Also, the timing mode selected by the keys 101, 102 can be changed prior to the copying operation of the actuation of the key 100 as explained in the foregoing, but a direct mode change from the state of key 101 to that of key 102 or from the state of key 102 to that of key 101 is also achievable if the key 101 or 102 to be actuated later is so designed to reset two other timers. Such structure is applicable also to the timers T1–T3 composed of flip-flops as explained above. In this manner it is made possible to achieve rapid change from the normal mode corresponding to the key 100 to other modes represented by the keys 101, 102, and the indicator lamps are simultaneously switched according to such change.

Furthermore, said timers or flip-flops T1–T3 may be reset by the clear key 43 shown in FIG. 3.

Figure 4:
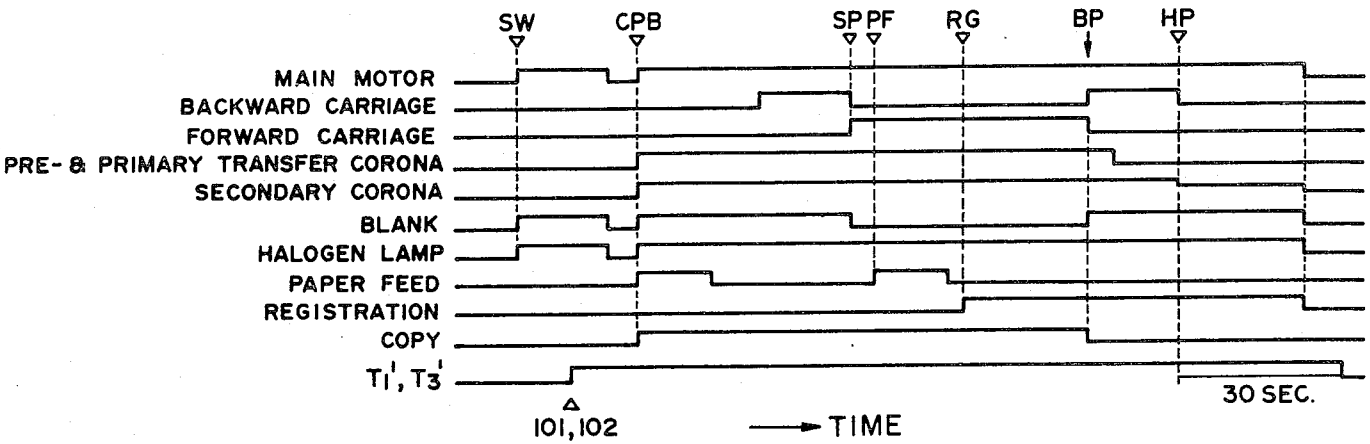
FIG. 4 is an operation timing chart useful for understanding the operation of the apparatus shown in FIG. 1.

The above-mentioned resetting or changing operation is disabled during the copy cycle, or during the functioning period of the main motor shown in FIG. 4, to prevent erroneous operation caused by careless key actuations. Also it is possible to adopt different timing modes during a series of copying cycles of a predetermined copy number if such resetting or changing of the timing mode is prohibited at least during the forward advancement of the carriage. Furthermore, the change of the timing mode is made possible at the completion of a series of copying cycles of a predetermined copy number by revoking such prohibition at the backward displacement of the carriage at the last copying cycle.

The above-mentioned change of timing mode is applicable for both the paper supply from the cassette and the manual paper supply. It is however possible also to allow such mode change in only one of the paper supply methods and to allow the normal timing mode alone in the other of the paper supply modes, preferably in the manual supply method, thereby enabling a cut-in copying with the normal mode during a series of copying cycles.

In case of a cut-in high-priority copying, the copy number entered by the numeral keys 42 is shifted to a memory in response to the actuation of an unrepresented high-priority copying key to enable entry of a new copy number. In such a case, the data entry operation for such cut-in high-priority copying can be facilitated if the timing mode is automatically reset to the normal state by the actuation of said high-priority key. Also the data entry operation for restarting the interrupted copying operation can be facilitated if the timing mode is automatically returned to the preceding mode at the completion of such high-priority copying or at the start of the interrupted copying operation.

The aforementioned feed and registering signals thus controlled are supplied to an input port of the central processor unit CPU, which identifies the first incoming signal entered after the start of forward displacement of the carriage as the feed signal to activate the feed rollers 13, 14, and also identifies the ensuing second signal as the registering signal to activate the registering roller 17. In this manner it is rendered possible to advance the transfer sheet to the image transfer station with a selected positional displacement with respect to the normal sheet position, thus enabling the formation of toner image in an arbitrary position on the transfer sheet.

Figure 8:
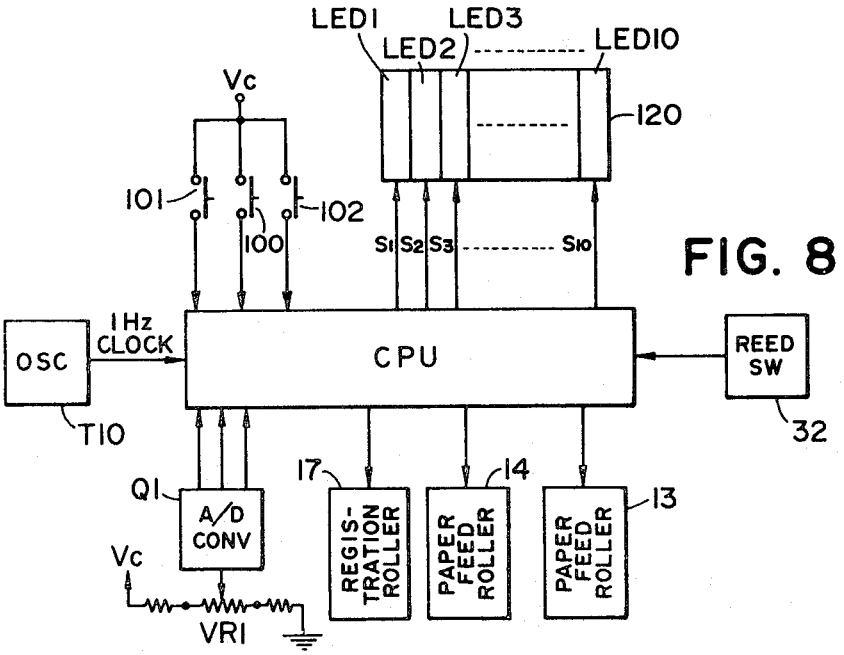
FIG. 8 is a schematic circut diagram of another example of the timing control circuit.

FIG. 8 shows another example of the circuit for timing control and display according to the present invention wherein a microcomputer CPU performs the sequence control of the copying apparatus in the manner as explained in the foregoing. In this case the timing control keys 100, 101 and 102 explained in the foregoing are connected to the appropriate input ports of said microcomputer, and the registering signal is also supplied thereto. There are also shown an oscillator T10 of a frequency on the order of 1 Hz, an A/D converter Q1 for converting an analog voltage determined by a variable resistor VR1 into a 3-bit digital number for regulating the position of the reproduced image, and a display unit 120 composed of ten light-emitting diodes LED-1–10.

Figure 9A:
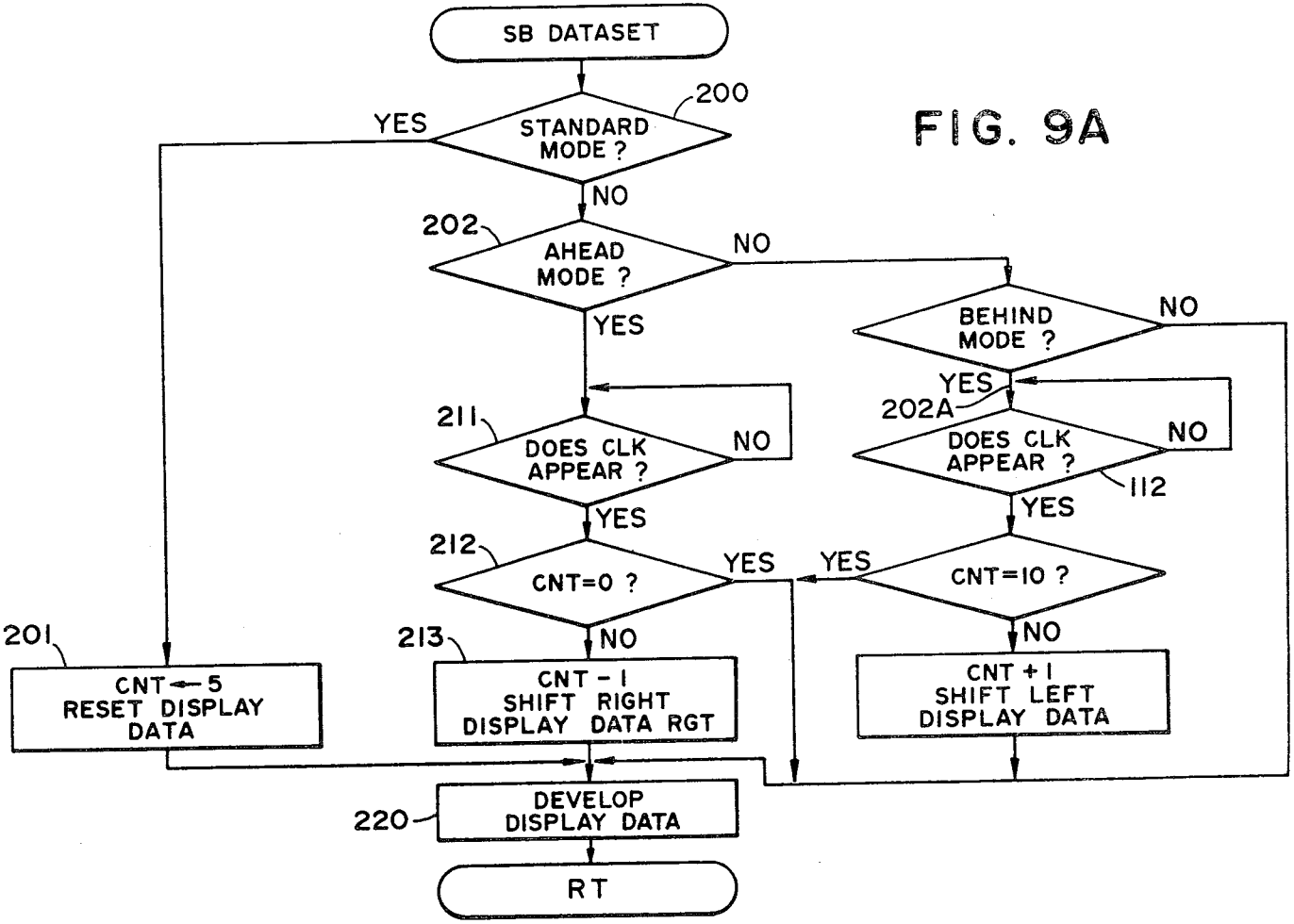
FIGS. 9A to 9C are control flow charts.
Figure 9B:
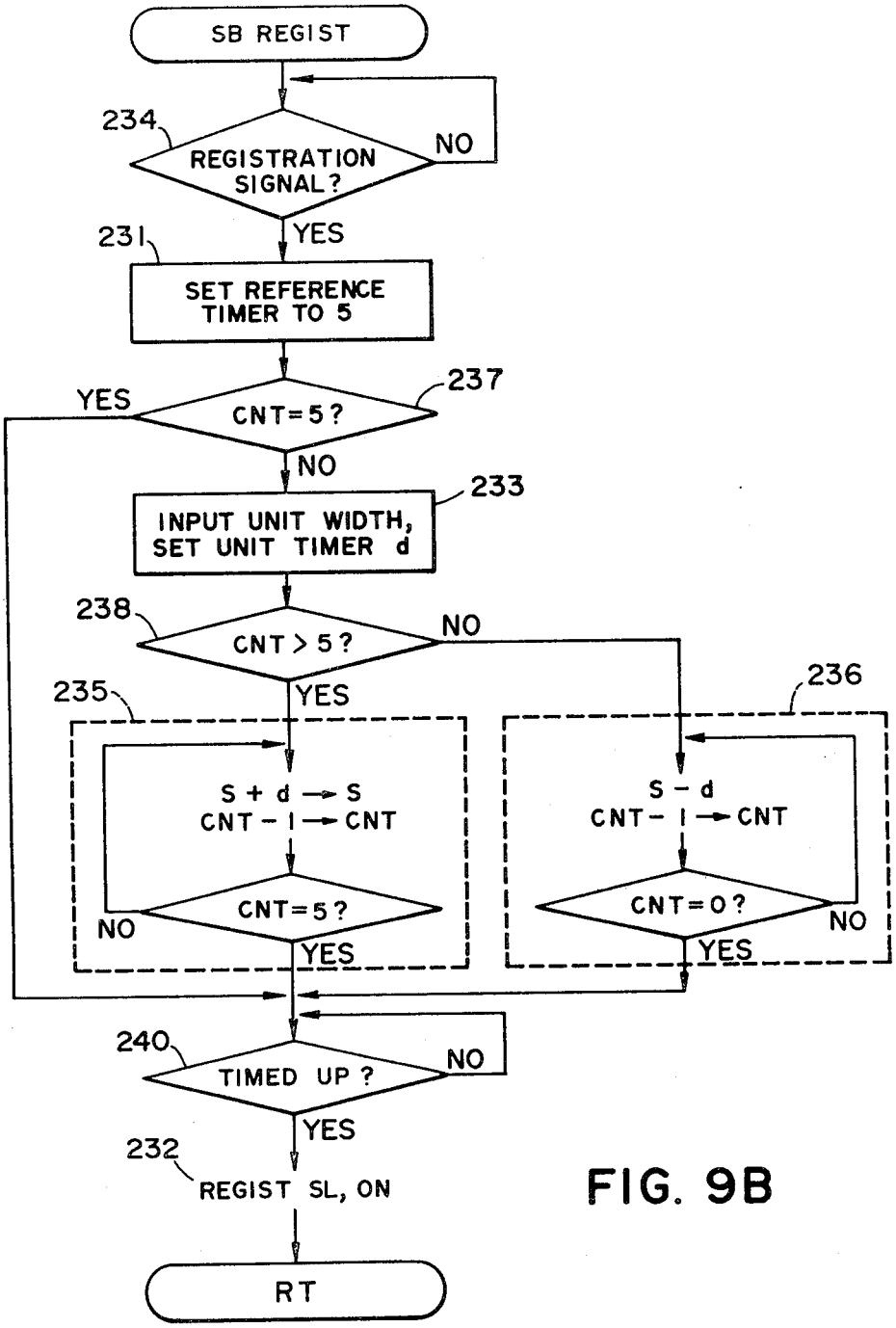
Figure 9C:
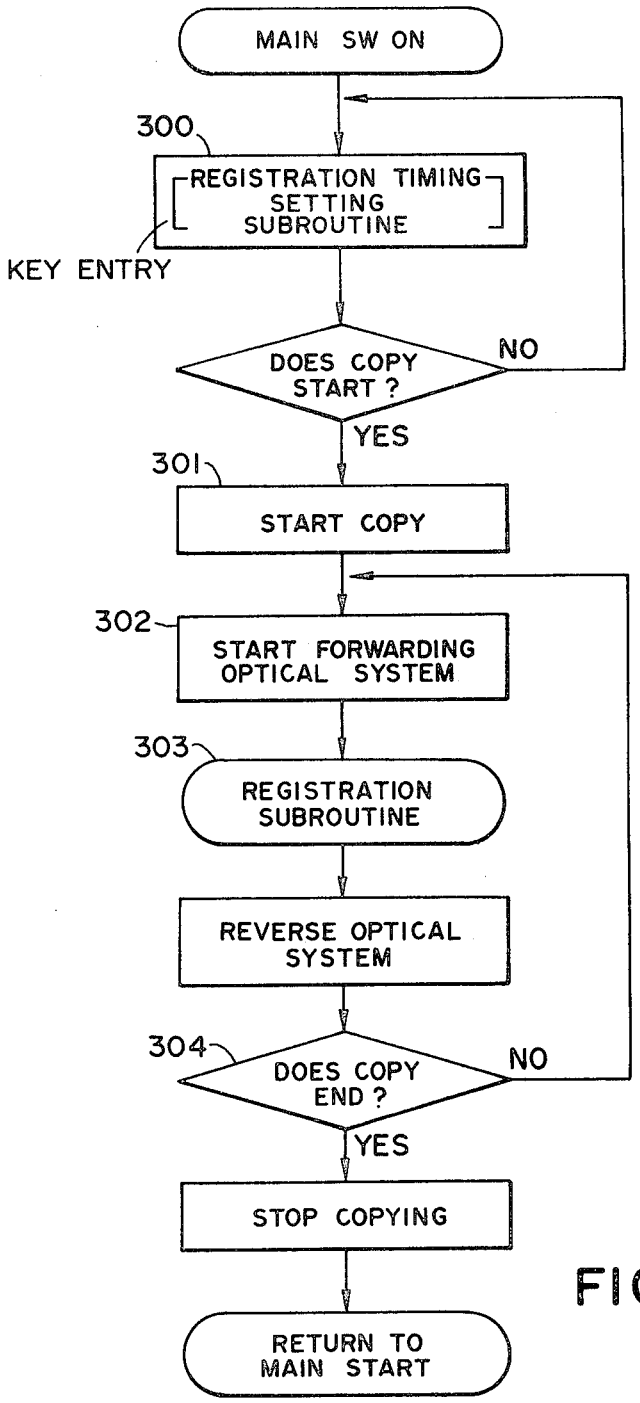

FIGS. 9A14 9C show the control flow charts according to a program stored in a program memory ROM provided in the CPU, wherein FIG. 9A shows a program routine for storing the paper feed timing selected by the keys 101, 102 into a register in the CPU as shown in FIG. 10 and indicating said timing on the indicator 120.

FIG. 9B shows a flow chart for changing the timing of paper feeding and registering according to the data stored in the register.

Also FIG. 9C shows a general flow chart of the copy sequence.

Figure 11:
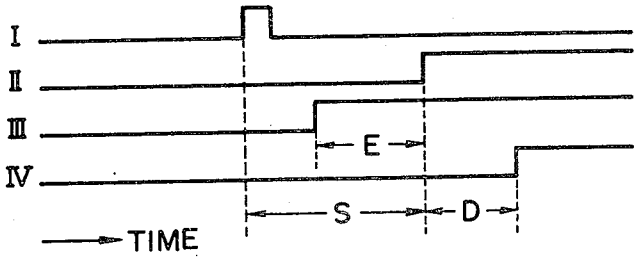
FIG. 11 is an operation timing chart useful for understanding the operation of the circuit shown in FIG. 8.

Also FIG. 11 is a time chart showing the operating timing of the registering roller shown in FIG. 8.

Figure 10A:
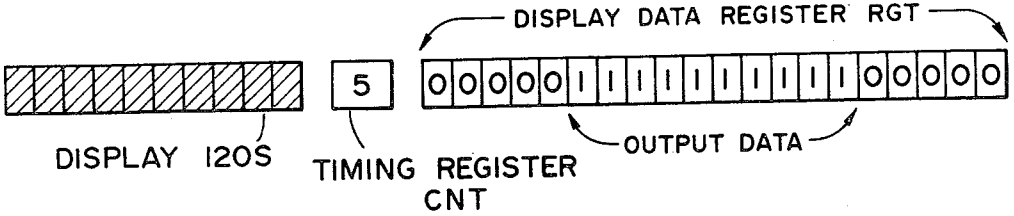
FIGS. 10A to 10C are schematic diagrams of the display unit.
Figure 10B:
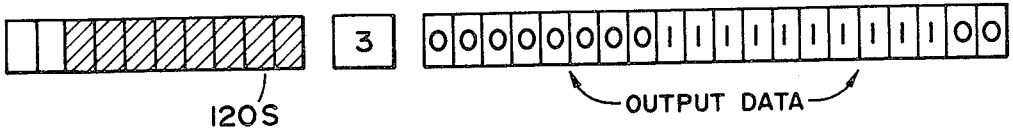
Figure 10C:
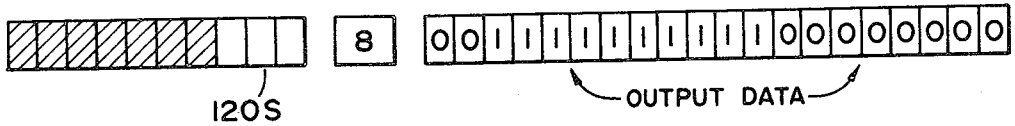

FIGS. 10A–10C are diagrams of the shift register for timing control.

In the following there is an explanation of the function of setting and indicating the timing data according to FIGS. 8, 9A, 9B, 9C, 10A, 10B and 10C.

In the normal paper feed timing mode achieved by the actuation of the key 100, the program identifies the input signal from the key 100 at the step 200 and executes the step 201, thereby storing data "5" for the standard mode in a timing register CNT and data composed of "0" and "1" in a display data register as shown in FIG. 10A. In the succeeding step 220 the central 10 bits of the display data register are supplied to the output ports S1–S10 to light the light-emitting diodes connected thereto. In this manner, in the standard mode, the register CNT stores "5" while the display data register stores the data shown in FIG. 10A, and the display units 120S are all lighted.

In case the key 1—1 is actuated to advance the paper feed timing, the actuation is identified in the step 202 to execute the clock identifying step 211, in which the program waits until the entry of low-frequency pulse of about 1 Hz from the clock generator T10. Upon receipt of one pulse the content of the timing register CNT is identified, and, if it is not zero, is decremented in the step 213. In case the key 101 is kept actuated, the decrement is repeated upon receipt of each subsequent pulse. When the content reaches zero, the program jumps the step 213 through the step 212 to terminate the decreasing operation. This state corresponds to the maximum advanced timing.

In response to the decrement of the content of the register CNT in the step 213, the content of the display data register RGT is shifted stepwise to the right, and this operation is repeated for each pulse while the key 101 is kept actuated. As an example, in the case wherein the key 101 is pressed, as distinguished from the standard state shown in FIG. 10A, for a period corresponding to the entry of two clock pulses, the content of the display data register RGT is shifted twice to the right as shown in FIG. 10B and the content of the register CNT is decremented twice to reach "3". At the step 220 the central 10 bits of the display data register RGT are supplied through the ports S1–S10 to the display units 120 whereby the light-emitting diodes LED1 and 2 are extinguished while LED3–10 are lighted.

In case the key 102 is actuated to delay the registering timing, the functions of the registers become opposite to those when the key 101 is actuated. Thus the content of the register CNT is decremented while the content of the display data register RGT is shifted to the left, according to the number of clock pulses entered during the actuation of key 102. As an example, if the key 102 is actuated for a period corresponding to the entry of three clock pulses from the standard state, the content of the register CNT is incremented three times to reach "8" while the display data register RGT reaches the state shown in FIG. 10C, whereby the light-emitting diodes LED1–7 are lighted but LED8–10 are extinguished in the display units 120S. The above-explained sub-routines are included in the key entry routine of the keys 40–43.

Now there will be explained the copying operation in the above-mentioned three modes.

FIG. 9C shows the main control routine stored in the read-only memory of CPU. In the stand-by state after the turning on of the main switch and prior to the start of the copying cycle, the program repeats the aforementioned registration timing setting sub-routine (SBDATASET) to set and display the contents of data registers and it stores the key signal from the keys 100, 101 and 102. When the copying cycle is started by the actuation of the copy switch 40, the original carriage initiates displacement in the step 302 and the program enters the registration sub-routine for detecting the registering signal. In this sub-routine the registration is controlled (step 303) according to the content of the register RGT in the manner as explained in the foregoing. Subsequently the original carriage is reversed, and, if it is a successive copying operation, the above-explained procedure is repeated. When the copying operation is completed, the program returns to the original stand-by state.

In the following the registration sub-routine program shown in FIG. 9C is explained in detail.

When the entry of the registering signal 32 shown in FIG. 8 is identified in the step 234 of the registration sub-routine shown in FIG. 9C, a timer S corresponding to the delay time in the normal mode is set, in the step 231, in a random access memory provided in CPU. Subsequently, in the step 237, the program identifies whether the content of the register CNT is equal to "5", and, if it is identified as the normal mode, initiates the counting of timer S in the step 240. Upon termination of the counting there is released a signal for energizing the registration solenoid SL in the step 232 to activate the registering roller shown in FIG. 8.

On the other hand, in case a non-normal mode is identified in the step 237, data d for a unit time is set in another area of the random access memory in the step 233, that data being variable by the variable resistor VR1 and supplied to the CPU after conversion into a 3-bit digital number by means of the A/D converter Q1. The data correspond to the unit shift time for determining the quantity of the advancement or delay of the registering timing. As the pulse interval is arbitrarily adjustable by the variable resistor VR1, the amount of shift is rendered variable even if the key 101 or 102 is actuated for a given period.

The step 238 then identifies whether the content of the register CNT is higher or lower than 5, i.e., a delayed or advanced shift, and the program proceeds to the step 235 or 236 according to the result of the identification. In step 235 or 236, a correction is made by adding or subtracting, respectively, the unit timer d to the standard timer S, by a number of times corresponding to the content of the register CNT, and the shifting time is thus determined.

For example if the content of the register CNT is "8" representing a delayed mode, the program proceeds to the step 235 in which the unit timer d is added to the standard timer S with simultaneous decrease of the content of the register CNT, and this procedure is repeated until the content reaches "5". In this example this procedure is repeated three times to bring the content of the register CNT to "5", whereby the standard timer S is added with a period equal to *3d.* the counting of the timer (S+3d) is initiated in the step 240, and the registering roller 17 is activated at the termination of said counting.

In the case of the advancing mode, for example when the content of the register CNT is equal to "3", a procedure of subtracting d from S and step decreasing the content of the register CNT is repeated until the content reaches "0". In this case the subtraction is conducted three times, so that the timer is corrected to S−3d, which is counted in the step 240. The registering roller is activated by the registering solenoid SL at the termination of the counting.

As shown in FIG. 11, in the normal mode, the registering roller 17 is activated after the lapse of a standard timer S, as shown by line II, from the entry of the registering signal I, thus causing the leading end of the transfer sheet to substantially coincide with that of the image.

In case the key 101 is actuated for example to obtain the register content "3" as shown in FIG. 10B, the registering roller 17 is activated earlier by three unit times than the starting time in the normal mode as shown in line III, thereby advancing the transfer sheet with respect to the leading end of the transfer sheet, thus creating a non-image area at the leading end of the transfer sheet. In this state the display units 120 perform an indication as shown in FIG 10B, wherein the extinguished light-emitting diodes LED1, 2 indicate the presence of a blank portion in the leading end.

On the other hand when the key 102 is actuated so as to obtain the register contents as shown in FIG. 10C, the registering roller is delayed by three unit times with respect to the normal mode, as shown in FIG. 11, line IV. The unit timer or the unit delay is arbitrarily adjustable by means of the variable resistor VR1.

Although the foregoing explanation has been limited to the registration control, a similar control is naturally applicable to the control of paper feed timing in relation to the switch 31. Also an automatic return to the normal mode after a determined period, for example 30 seconds, is easily achievable in a similar manner as explained in connection with the embodiment shown in FIG. 6.

It is also possible to form the reproduced image in a desired position of the transfer sheet by suitable selecting the timing for initiating the original scanning by means of the aforementioned keys. In this case the aforementioned control is applied not to the switches 31, 32 but to the scanning start switch 30 shown in FIG. 2 in such a manner that the carriage displacement to the right after leftward displacement from the original position switch 35 is initiated with a delay determined by the key entry after the switch 30 is actuated. A similar application is also possible in a copier in which the original carriage is fixed while the lamp and mirrors perform reciprocating motion.

Furthermore, in place of the manual key entry of the correction of image position in the foregoing embodiment, it is possible, in a copying apparatus having or connectable to an automatic sorter or collater, to realize an automatic positional correction to form a collating margin when such sorter or collater is in operation. Such correction is achievable by generating a timing advancing signal in response to the connection of the sorter to the copier or to the start of sorter operation.

The timing control for the paper feed roller and registering roller expands the maximum correction of the size of the transfer sheet, thus enabling effective utilization of the marginal area, for example for space for memorandum. Also in the case of copying two opened pages of an A3-sized book on two A4-sized sheets, it is possible to achieve such copying without moving the original by at first copying one page with the normal mode and then copying the other page with a delay of the transfer sheet corresponding to A4 size.

Also, in the foregoing embodiment the displacement of the image is controlled and displayed as the absolute amount from the standard portion of the leading or trailing end of the reproduced image, but it is easily possible also, by entering the size of transfer sheet into the CPU shown in FIG. 8, to control and/or display the displacement in the relative ratio with respect to the size of the transfer sheet.

As detailedly explained in the foregoing, the present invention allows, with a simple operation, the correct positioning of a reproduced image on the transfer sheet without repositioning the incorrectly placed original document incorrectly placed on the carriage, to obtain a displaced image on the transfer sheet for obtaining a filing margin, and to achieve positional correction of the reproduced image in the case of copying a bound original.

What we claim is:

1. Copying apparatus comprising:

means for forming a reproduced image of an original on a copy material means for entering data necessary for image formation, said data entering means comprising instruction means for selecting the position of the reproduced image on said copy material;

means for performing timing control of said image forming means for image formation in response to the data entered by said data entering means, said timing control means comprising copy material feed control means provided with switching means to be actuated by said image forming means and timer means associated with said switch means, and timer control means for controlling operation of said timer means for shifting feed timing of said feed control means in response to the instruction data supplied from said instruction means; and means for displaying feed timing of said feed means.

2. Copying apparatus according to claim 1, wherein said instruction means comprises manual keys for arbitrarily shifting the feed timing within a determined extent from a standard timing.

3. Copying apparatus according to claim 2, wherein said keys are adapted to set an arbitrary shift amount according to a period of actuation thereof.

4. Copying apparatus according to claim 2, wherein said display means comprises light-emitting devices adapted to indicate the extent of the arbitrary shifting by means of the number of lighted and extinguished light-emitting devices.

5. Copying apparatus comprising:

means for forming an image of an original on a copy material, said image forming means comprising means for repeatedly feeding said copy material to an image forming station;

means for entering data necessary for image formation, said data entering means comprising instructions means for generating a plurality of instruction data each for correcting the position of a reproduced image in a determined direction on said copy material;

means for holding said plurality of instruction data in response to said instruction means; and means for performing timing control of the image forming means for image formation in response to the data entered by said data entering means, said timing control means comprising means for shifting the feed timing of said feed means from a determined timing by a predetermined amount in response to each instruction data supplied from said instruction data holding means.

6. Copying apparatus according to claim 5, wherein said instruction means is adapted to select a shift of the position of a reproduced image ahead of or behind a standard position.

7. Copying apparatus according to claim 5, wherein said feed means comprises means for feeding said copying material in registration with a rotary member for forming a transferred image.

8. Copying apparatus according to claim 5, wherein said control means comprises means for forbidding correction by said instruction means during a series of repetitive copying cycles.

9. Copying apparatus comprising:

means for forming an image of an original on a copy material, said image forming means comprising a reciprocatable member for scanning said original;

means for entering data necessary for image formation, said data entering means comprising instruction means for correcting the position of a reproduced image in a determined direction on said copy material; and means for performing timing control of the image forming means for image formation in response to the data entered by said data entering means, said timing control means comprising means for shifting advancement start timing of said reciprocatable member by a determined amount ahead of or behind a determined timing in response to the instruction data supplied from said instruction means.

10. Copying apparatus according to claim 9, wherein said instruction means is adapted to select a shift of the position of a reproduced image ahead of or behind a standard position.

11. A copying apparatus comprising:

means for forming an image of an original on a copy material;

means for entering data necessary for image formation, said data entering means comprising instruction means for correcting the position of a reproduced image on said copy material;

means for performing timing control of the image forming means for image formation in response to the data entered by said data entering means, said timing control means comprising means for shifting the image by a determined amount ahead of or behind a determined timing in response to the instruction data supplied from said instruction means; and means for displaying the shift data in response to the instruction data.

12. A copying apparatus comprising:

means for forming an image of an original on a copy material;

means for entering data necessary for image formation, said data entering means comprising instruction means for correcting the position of a reproduced image on said copy material;

means for counting serial pulses; and means for performing timing control of the image forming means for image formation in response to the data entered by said data entering means, said timing control means comprising means for shifting the image by a determined amount ahead of or behind a determined timing in response to the instruction data supplied from said instruction means and the counted pulses by said counting means.

13. A copying apparatus comprising:

means for forming an image of an original on a copy material;

means for entering data necessary for image formation, said data entering means comprising instruction means for correcting the position of a reproduced image on said copy material; and means for changing position correction data, entered from said instruction means, to data for instructing a predetermined position of a reproduced image after a predetermined time measured from the correction data entry.

14. A copying apparatus comprising:

means for forming an image of an original on a copy material;

means for entering data necessary for image formation, said data entering means comprising instruction means for correcting the position of a reproduced image on said copy material; and means for inhibiting the entering operation of said data entering means during image formation.

* * * * *

UNITED STATES PATENT AND TRADEMARK OFFICE

CERTIFICATE OF CORRECTION

PATENT NO. : 4,451,136

DATED : May 29, 1984

INVENTOR(S) : Hiroshi Tanioka, et al.

It is certified that error appears in the above-identified patent and that said Letters Patent is hereby corrected as shown below:

COLUMN 1

Line 20, delete "as".

Line 53, after "of" insert --a--.

COLUMN 2

Line 49, after "transferring" insert --the--.

COLUMN 3

Lines 4 and 28, change "celfoc" to read --selfoc--.

COLUMN 4

Line 7, after "of" insert --the--.

COLUMN 5

Line 3, after "obtain" insert --a--.

Line 52, after "of" insert --the--.

COLUMN 6

Line 19, after "of" insert --the--.

Line 57, after "for" insert --a--.

UNITED STATES PATENT AND TRADEMARK OFFICE

CERTIFICATE OF CORRECTION

PATENT NO. : 4,451,136

DATED : May 29, 1984

INVENTOR(S) : HIROSHI TANIOKA, ET AL.

It is certified that error appears in the above-identified patent and that said Letters Patent is hereby corrected as shown below:

COLUMN 7

Line 21, "detects or not" should read --does or does not detect--.

Line 23, after "of" insert --a--.

COLUMN 10

Line 16, "FIGS. 9A149C" should read --FIGS. 9A-9C.

COLUMN 11

Line 65, "correspond" should read --corresponds--.

COLUMN 12

Line 39, after "actuated" insert --,--.

Line 65, "suitable" should read --suitably--.

UNITED STATES PATENT AND TRADEMARK OFFICE

CERTIFICATE OF CORRECTION

PATENT NO. : 4,451,136

DATED : May 29, 1984

INVENTOR(S) : HIROSHI TANIOKA, ET AL.

It is certified that error appears in the above-identified patent and that said Letters Patent is hereby corrected as shown below:

COLUMN 13

Line 48, after "material" insert --;--.

Signed and Sealed this

*Fifth* Day of *March 1985*

[SEAL]

*Attest:*

DONALD J. QUIGG

*Attesting Officer* *Acting Commissioner of Patents and Trademarks*